US007644771B2

(12) United States Patent
Bussear

(10) Patent No.: US 7,644,771 B2
(45) Date of Patent: Jan. 12, 2010

(54) FLUID LOSS CONTROL SYSTEM AND METHOD FOR CONTROLLING FLUID LOSS

(75) Inventor: Terry R. Bussear, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 167 days.

(21) Appl. No.: 11/838,529

(22) Filed: Aug. 14, 2007

(65) Prior Publication Data

US 2008/0041595 A1 Feb. 21, 2008

Related U.S. Application Data

(60) Provisional application No. 60/837,999, filed on Aug. 16, 2006.

(51) Int. Cl.
*E21B 43/12* (2006.01)

(52) U.S. Cl. ..... 166/373; 166/119

(58) Field of Classification Search ..... 166/191, 166/313, 227, 158, 157, 205, 115
See application file for complete search history.

(56) References Cited

U.S. PATENT DOCUMENTS

| | | | | |
|---|---|---|---|---|
| 3,543,849 | A * | 12/1970 | Kilgore | 166/128 |
| 5,348,092 | A * | 9/1994 | Cornette et al. | 166/227 |
| 6,302,216 | B1 * | 10/2001 | Patel | 166/375 |
| 6,354,378 | B1 * | 3/2002 | Patel | 166/374 |

FOREIGN PATENT DOCUMENTS

| | | |
|---|---|---|
| EP | 0724065 | 7/1996 |
| EP | 724065 A2 * | 7/1996 |
| WO | WO 00/29715 | 5/2000 |
| WO | WO 2005/045191 | 5/2005 |

OTHER PUBLICATIONS

Stair, Craig D., Dawson, Mark E.P., Jacob, Suresh, Hebert, Darrell D. B., "Na Kika Smart Wells Design and Construction", AAPG International Conference, Oct. 24-27, 2004, Cancun Mexico, pp. 1-7.

A. Penno, H. Fitpatrick, "A Flexible Large-Bore Sand-Control completion design Improves completion Results in all Multi-Zone, High-Rate, Frac-Pack Well Scenarios Requiring Zonal Selectivity", Presentation at the 2005 Offshore Technology conference, OTC 17477, Houston, TX, 2-5 AMy 2005, pp. 1-9.

G. Lehle, D. Bilberry, "Optimizing Marginal Subsea Well Developments Through Application of Intelligent Completions", Presentation at the 2003 Offshore Technology Conference, OTC 15193, Houston, Texas, May 5-8, 2003, pp. 1-6.

International Search Report; International Application No. PCT/US2007/075920; Date Filed Aug. 14, 2007; Date Mailed Jan. 3, 2008.

* cited by examiner

*Primary Examiner*—David J Bagnell
*Assistant Examiner*—James G Sayre
(74) *Attorney, Agent, or Firm*—Cantor Colburn LLP

(57) ABSTRACT

A fluid loss control system having a loss control valve and a plurality of zones including an isolation assembly disposed in a wellbore and a string having a stinger at a downhole most end thereof. The string is supportive of a moveable seal at a selected position uphole of the stinger, the position being calculated to cause engagement of the seal with the isolation assembly and to position the moveable seal to facilitate fluid-flow around the seal when the stinger is engaged with a seal bore of one of the plurality of zones. A method for controlling fluid loss including isolating a fluid column uphole of a pressure seal spaced from the lower completion, opening a fluid loss control valve, stabbing a stinger into a seal bore of the lower completion, and positioning the seal to facilitate fluid flow therearound.

20 Claims, 7 Drawing Sheets

FLUID LOSS CONTROL SYSTEM AND METHOD FOR CONTROLLING FLUID LOSS

CROSS REFERENCE TO RELATED APPLICATIONS

This application claims priority to provisional application 60/837,999 filed Aug. 16, 2006, the entire contents of which are incorporated herein by reference.

BACKGROUND

In the hydrocarbon exploration and recovery industry, lower completion zones and upper completion zones often are installed separately and therefore require connection in the downhole environment. Facilitating such connection are numerous types of wet connect devices, procedures and configurations. In some cases, this type of connection presents no difficulty at all, while in others properties of the wellbore or formation itself can make such connections difficult and potentially costly. One such situation includes formations where fluid loss is likely to be excessive during connection. Moreover, in such wells there is the additional possibility that gas will escape the formation into the well where the fluid loss is great enough that the well becomes underbalanced (providing there is gas in the formation to enter the wellbore). The possibility of gas entrance to the wellbore is particularly onerous since in order to run the upper completion string, the surface blowout preventer and other mechanical well control barriers must be in a disengaged condition. This would mean that additional measures are required, adding to costs associated with bringing the well on line. The fluid loss itself also represents a significant cost. Since cost is always a parameter of production that is desirably reduced, the art would well receive configurations and systems that avoid additional measures and thereby avoid cost.

SUMMARY

Disclosed herein is a fluid loss control system for wells having a loss control valve and a plurality of zones. The system includes an isolation assembly disposed in a wellbore and a string having a stinger at a downhole most end thereof. The string is supportive of a moveable seal at a selected position uphole of the stinger, the position being calculated to (1) cause engagement of the seal with the isolation assembly before the stinger is engageable with the valve and (2) to position the moveable seal relative to the isolation assembly to facilitate fluid-flow around the seal when the stinger is engaged with a seal bore of one of the plurality of zones.

Further disclosed herein is a method for controlling fluid loss to a downhole formation where a lower completion is installed and a fluid loss control valve is disposed at an uphole end of the lower completion. The method includes isolating a fluid column uphole of a moveable pressure seal spaced from the pack, opening the fluid loss control valve, stabbing a stinger into a seal bore of the pack, and positioning the moveable seal to facilitate fluid flow therearound from the fluid column uphole of the moveable seal.

BRIEF DESCRIPTION OF THE DRAWINGS

Referring now to the drawings wherein like elements are numbered alike in the several Figures.

DETAILED DESCRIPTION

Figure 1A:
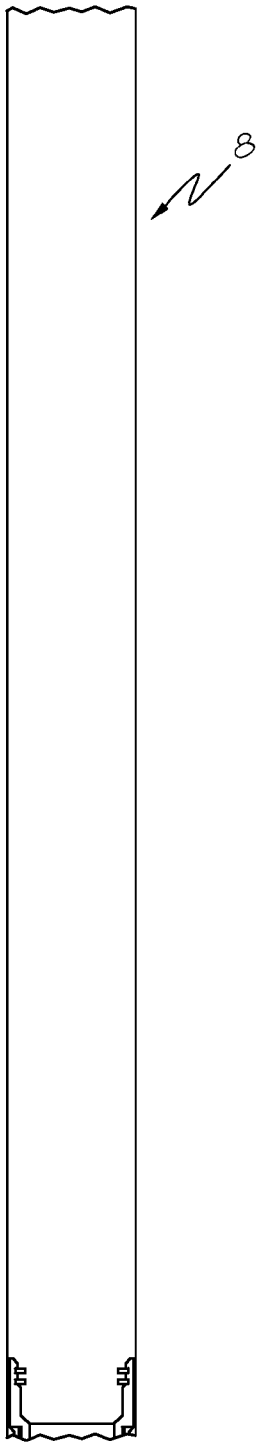
FIGS. 1A-C are an extended view of a well system having a plurality of zones and a fluid loss control valve disposed between areas of high pressure and low pressure in a wellbore.
Figure 1B:
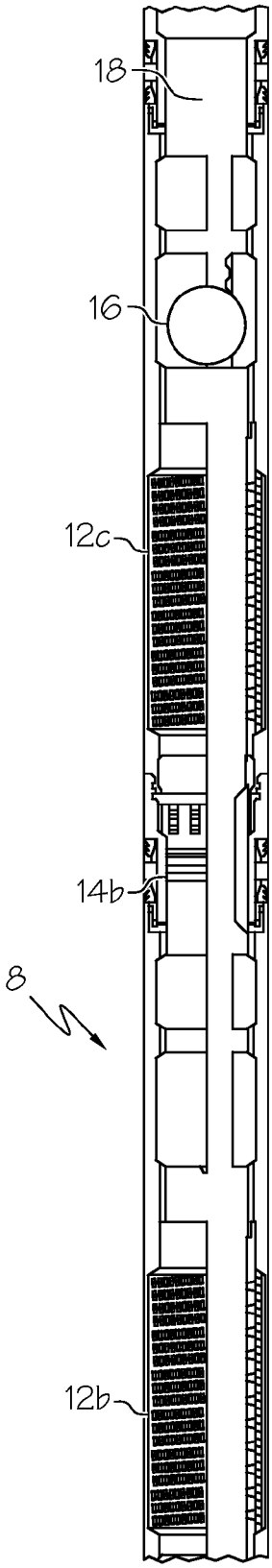
Figure 1C:
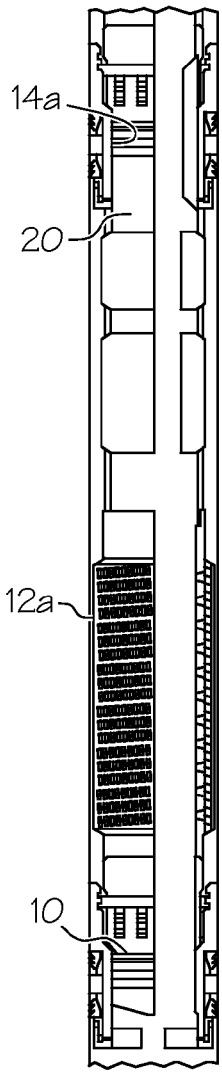

Referring to FIGS. 1B and C first, a lower completion such as, for example, a multizone gravel pack or frac pack (referred to herein as such but not intended to be so limited) is illustrated in a wellbore 8. It is to be understood that lower completion is intended to mean a completion structure that is more downhole than another completion structure. One of skill in the art will recognize such features as sump packer 10, screens 12*a-c*, and packers 14*a* and 14*b*. A fluid loss control valve 16 resides at an uphole end of the gravel or frac pack zones. The fluid loss control valve 16 holds hydrostatic pressure from the fluid column 18 uphole of the valve 16 thereby separating that pressure area from a lower pressure area 20 downhole of valve 16. It is this pressure differential that creates the difficulty in connecting an upper completion as discussed in the background section of this application.

More specifically, because area 18 is of significantly greater pressure than area 20, opening valve 16 will cause fluid from area 18 to escape to the formation (not shown) through screens 12. In cases where a sufficient amount of fluid from area 18 escapes to the formation (with attendant cost) that the pressure in the fluid column of area 18 becomes less (due to fluid head loss) than a pressure of—reservoir fluids in the formation, reservoir fluids will then tend to exit the formation into the wellbore and flow unchecked to surface. This would require additional equipment and materials to deal with both the make-up of well control fluids from the surface and the influx of reservoir fluids, which equipment and materials would not otherwise be necessary for the well operator to have. As this is undesirable, the system disclosed herein has been developed to alleviate the problem.

Figure 2A:
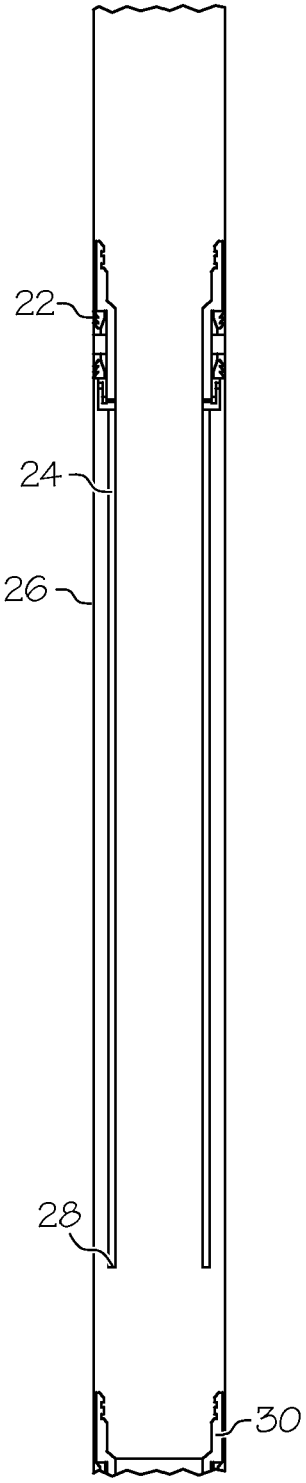
FIGS. 2A-C are the extended view of FIGS. 1A-C adding a packer and a sealbore.

Referring to FIG. 2A, an isolation assembly 21, comprising a packer 22 and a sealbore 24, is illustrated installed into an upper completion zone area 26 of the wellbore 8. The length of the sealbore is important as will be further understood hereunder. In this embodiment, it is important that the packer 22 and sealbore 24 be properly spaced from valve 16 in order to ensure that a downhole end 28 of sealbore 24 is at an operable distance from valve 16. The illustration of FIG. 2A shows sealbore 24 having the downhole end 28 spaced from a packer 30 associated with the valve 16. The length of this space is also important and will be discussed in more detail subsequently in this document.

Figure 3A:
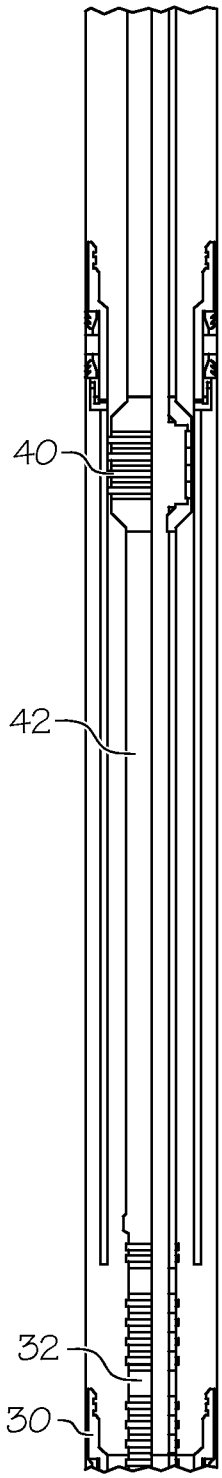
FIGS. 3A-C are the extended view of FIGS. 1A-C adding a seal and stinger.
Figure 3B:
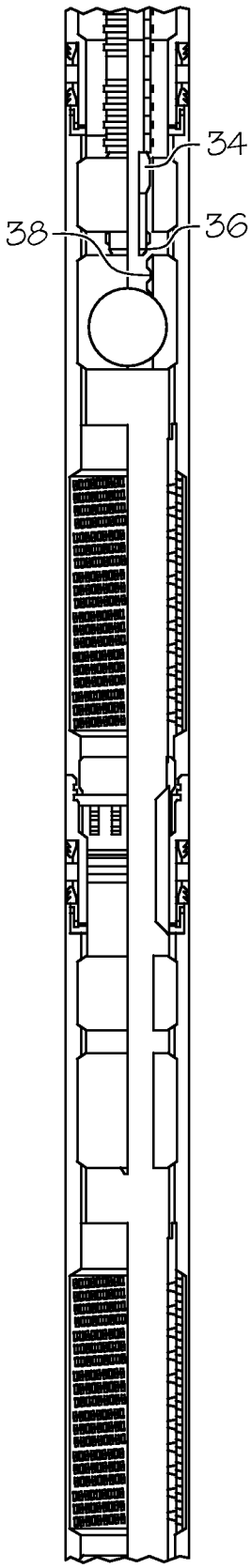
Figure 3C:
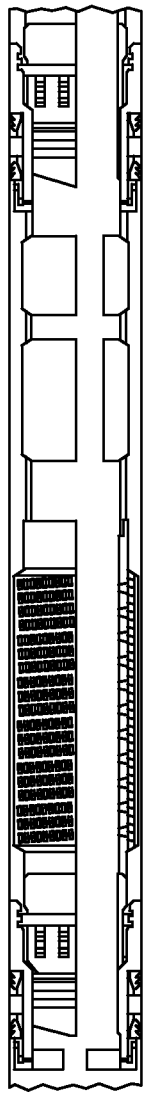
Figure 4A:
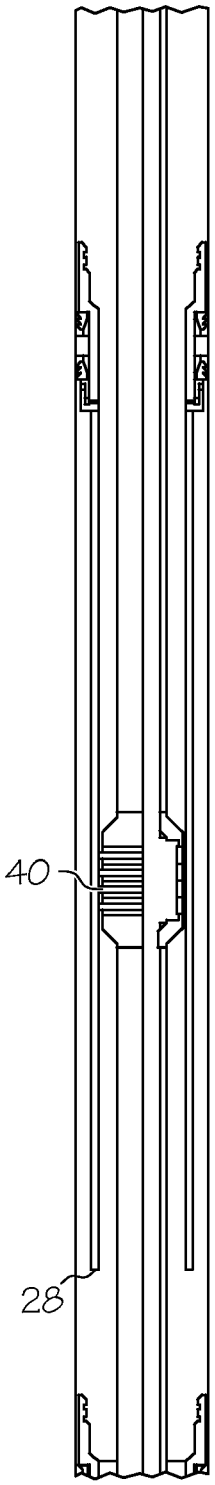
FIGS. 4A-C are the extended view of FIGS. 1A-C with the seal and stinger further engaged.
Figure 4B:
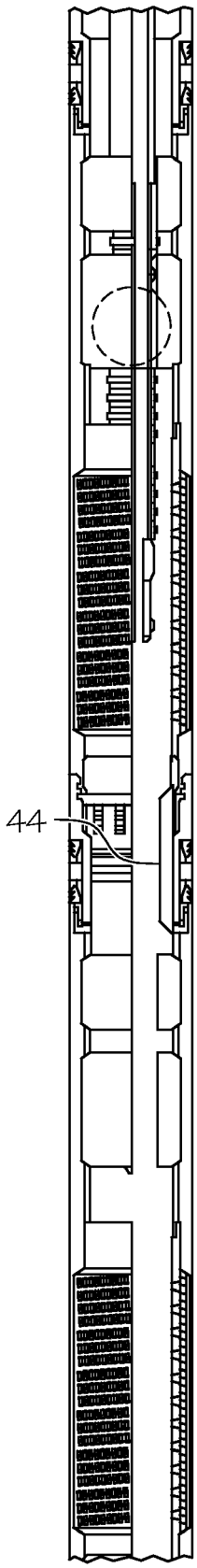
Figure 4C:
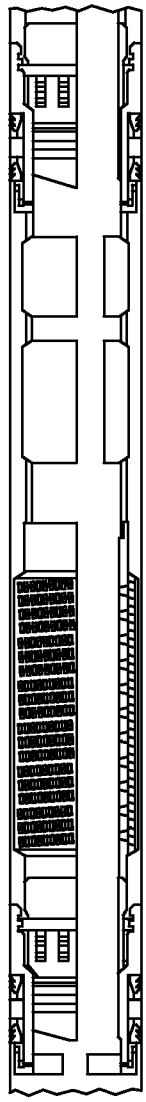

Referring now to FIGS. 3A and B, a stinger 32 is illustrated passing through sealbore 24 and into packer 30. A downhole end 34 of stinger 32 includes a shifting tool 36 configured to engage a shifting actuator 38 of valve 16. In FIG. 3B, the shifting tool 36 is about to engage the actuator 38. Before the valve 16 is opened, a moveable pressure seal 40 mounted in spaced relation to the stinger 32 must be in sliding pressure sealing engagement with sealbore 24 as it is this seal in addition to packer 22, which must hold the hydrostatic pressure from uphole thereof thereby preventing the fluid column uphole thereof from being lost to the formation through valve 16 and screens 12 once the valve 16 is open. For this reason, the stinger and seal 40 must be properly spaced out with spacer 42 to ensure that stinger 32 enters its target components and seal 40 enters its target components at the appropriate times. More specifically, the seal 40 must be in the sealbore 24 and in pressure sealing contact therewith prior to the stinger shifting the valve 16 to the open position to prevent the fluid column at area 18 from rushing into area 20.

An astute reader will notice that at the moment seal 40 is in sealing engagement with sealbore 24. The stinger assembly will become hydraulically locked. For this reason, a pressure bleed path is needed. This pressure relief may be created wherever is convenient for the particular application. In the present application, it is assumed that the pressure bleed path is occasioned by a valve that is selectively opened and closed uphole of the isolation assembly 21.

Assuming, as noted, that a bleed path exists, seal 40 is advanceable along with stinger 32. As shifting tool 36 engages shifting actuator 38 and opens valve 16, the higher-pressure fluid downhole of packer 22 and seal 40 will be lost to the formation through the valves 16. While this is the same type of fluid loss the invention is designed to prevent, the volume of fluid downhole of packer 22 and seal 40 is very small and by contrast to all of the fluid at area 18, inconsequential. The balance of fluid 18 uphole of seal 40 and packer 22 is held back by the seal 40 and packer 22. This fluid is then controllable by the upper completion.

Figure 5A:
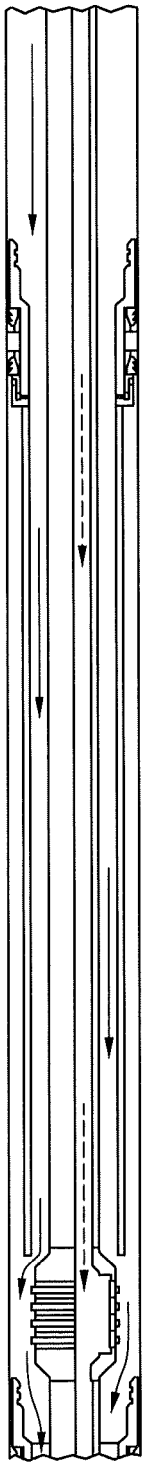
FIGS. 5A-C are the extended view of FIGS. 1A-C with the seal and stinger fully engaged.
Figure 5B:
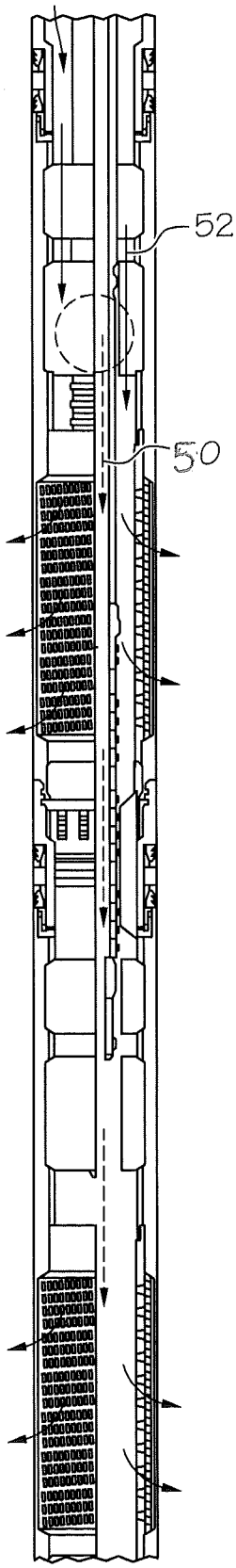
Figure 5C:
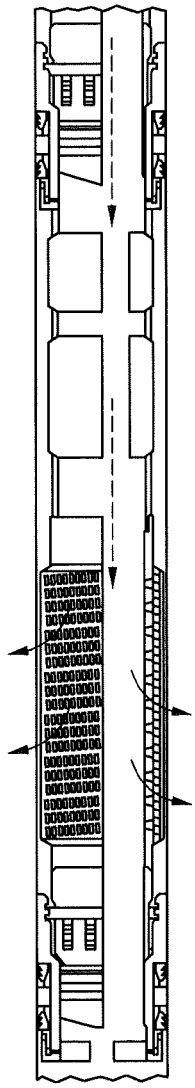

In order to render the functionality illustrated in drawing FIGS. 5A-C of two separate flows, i.e. one through the uphole most screen 12 and a second flow through the two farther downhole screens, the stinger 32, subsequent to opening the valve 16, is to seal within a seal bore 42 in packer 14*b*. The seal with bore 42 is to be accomplished before seal 40 exits the downhole end 28 of sealbore 24. Once the stinger is fully sealed in the seal bore 42, the seal 40 may be positioned to allow fluid flow around it to supply the upper zone.

Referring to FIG. 5, the seal 40 is illustrated having exited the sealbore 24 and flow lines are illustrated. In the drawing, broken lines are used to differentiate one flow 50 from the other flow 52 (utilizing solid lines). As can be seen in FIG. 5, seal 40 is in a final position where it has moved downhole of the downhole end 28 of sealbore 24 and is positioned uphole of packer 30 and valve 16. As such, flow stream 52 routes around seal 40, through valve 16 and out the uphandlemost screen 12C. This stream 52 is maintained separately from flowstream 50 by stinger 32 and spacer 42. Flow stream 50 on the other hand is routed through an ID of stinger 32 to screens 12A and 12B. It will be appreciated that although the flow streams 50 and 52 are illustrated to flow to the particular zones shown, it is easily possible to reconfigure the flows to swap positions utilizing a cross-flow system such as that available under part number H70044 from Baker Oil Tools, Houston Tex. This tool could be advantageously placed at various positions within the well. One reason it might be desirable to reverse the flow paths is that the formation conditions in the upper zone versus the lower zone(s) could dictate higher or lower fluid pressures, flow rates or flow volumes. Depending upon the configuration of the upper completion string, pressure bias may be toward the inside dimension of the string or to the annulus of the string, warranting consideration of which flow is most desirable to go to which zone.

The system described maintains full well control and reduces fluid loss to an inconsequential volume or inconsequential effect.

Figure 2B:
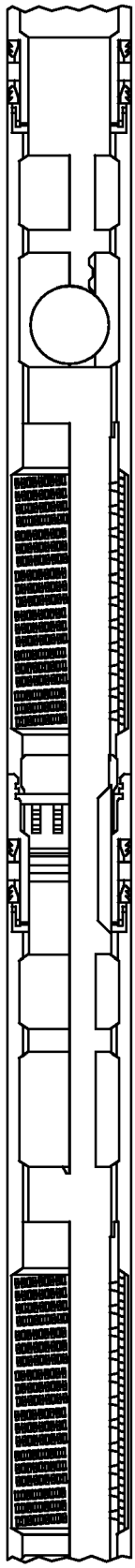
Figure 2C:
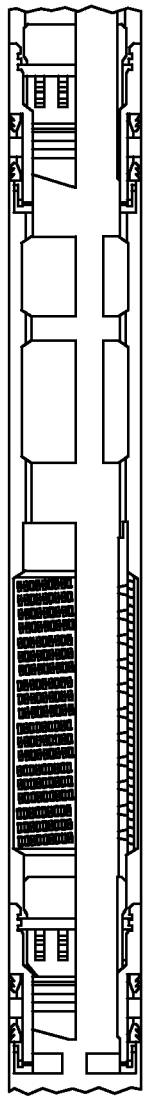
Figure 6:
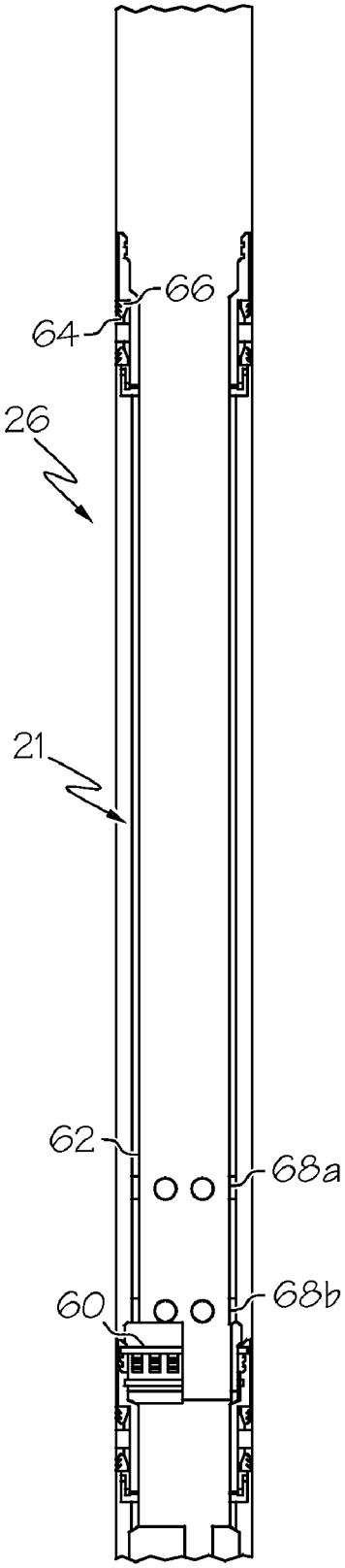
FIG. 6 is to be substituted for FIG. 2A to create an illustration with FIGS. 2B and C of an alternative embodiment.
Figure 7:
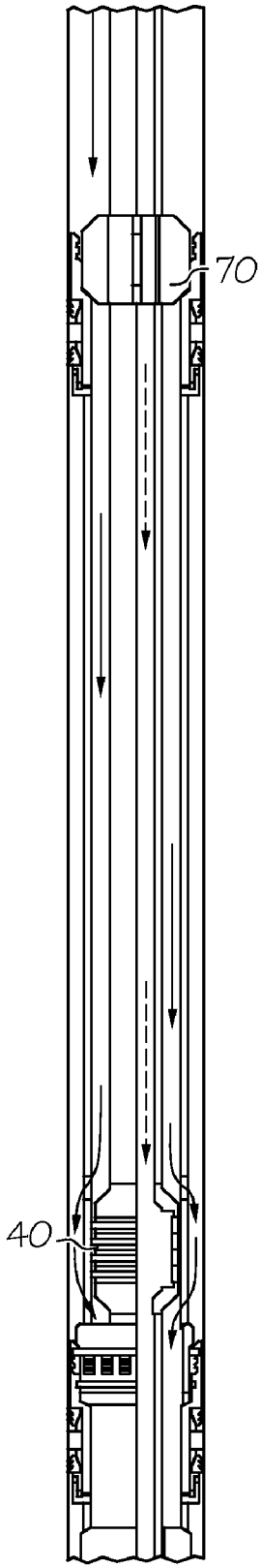
FIG. 7 is to be substituted for FIG. 5A to create an illustration with FIGS. 5B and 5C of an alternate embodiment.

In an alternate embodiment of the forgoing system, referring to FIGS. 6 and 7, space out control can be simplified by landing a connector 60 having a ported sleeve 62 extending therefrom (in an uphole direction), which sleeve terminates at a packer 64. The packer further includes no-go shoulder 66. Ported sleeve 62 includes a plurality of ports 68 configured to facilitate fluid flow around an obstruction disposed between the plurality of ports. It is noted that FIGS. 6 and 7 should be used to replace FIGS. 2A and 5A respectively and are to be used with FIGS. 2B,C and 5B,C as the lower hole portions of this embodiment are identical to that shown in the first embodiment.

In the illustrated embodiment in FIG. 6, uphole ports 68A are annularly arranged, with downhole ports 68B being a mirror image thereof. It is not necessary that the ports be laid out in this manner nor that a particular number of ports be used but rather what is important is merely that a sufficient flow volume can circumvent an obstruction between the plurality of ports (i.e. seal 40). It will be apparent to the reader that this embodiment is similar in many ways to the foregoing embodiment except that because of the use of the connector 60 and the ports in the sleeve 62, it is not important to carefully measure where to set the packer 64. Rather than like packer 22, in this embodiment one need merely run in the hole and stab the connector 60 into packer 30. Spacing for the sleeve 62 and therefore for the seal 40 and stinger 32 with respect to the sleeve and the seal bore in packer 24B will happen automatically. Referring to FIG. 7, a flow-through, no-go collar 70 is visible in shoulder 66 and the seal 40 is positioned between ports 68A and 68B. In most respects then FIG. 7 is the same as FIG. 5 except that flow 52 goes out through ports 68A uphole of the seal 40 and back into the inside dimension of the spacer 42 through ports 68B downhole of seal 40. No-go collar 70, when seated against shoulder 66 ensures that the seal 40 is positioned directly between ports 68A and 68B and seal 40 does not present obstruction to flow through the ports. Flow characteristics of FIG. 7 are otherwise the same as that of FIG. 5A, including the possibility of reversing the flows 50 and 52 with a cross-flow system.

Further disclosed herein is a method for controlling fluid loss. The method includes isolating the fluid column uphole of a downhole completion so that when the valve 16 of the downhole completion is opened, fluid from the column above is not lost to the formation. The method includes placing a seal in an isolation assembly uphole of the valve 16 that is capable when receiving a seal 40 to hold the hydrostatic pressure of the fluid column while the upper completion is fully engaged with the lower completion. Thereafter, the upper completion controls the well. The method includes running the seal 40 and a stinger 32 into the well to both land the seal 40 in the sealbore 24 and then shift the valve 16 to the open position. With the seal 40 slidingly in the sealbore 24 and holding pressure from the column, the stinger is moved into position in the second packer 12B, whereafter, the fluid column is controllable by the upper completion. The seal 40 is then moved to a position that allows annular flow around the seal 40 to complete the operation.

Figure 8:
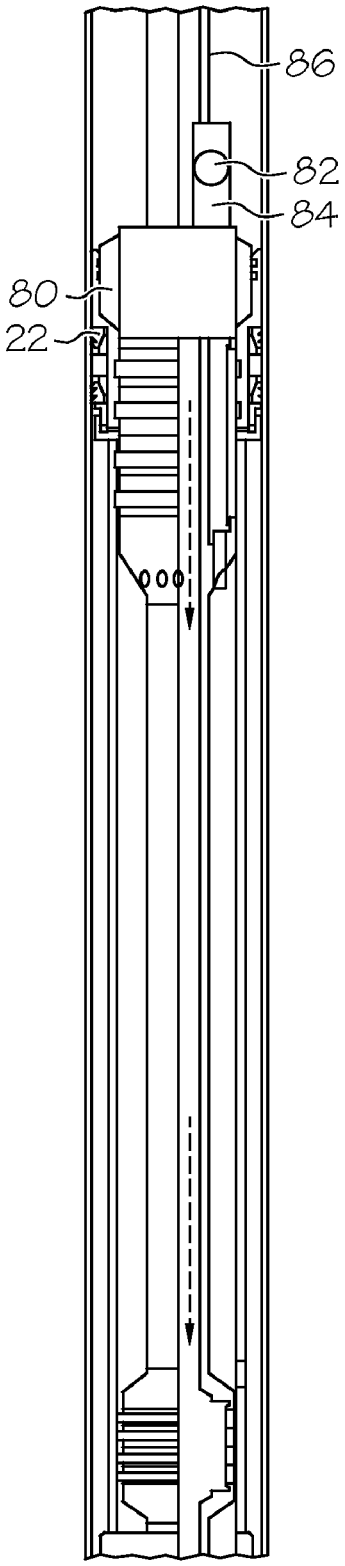
FIG. 8 is to be substituted for FIG. 5A to create an illustration with FIGS. 5B and 5C of an alternate embodiment.
Figure 9:
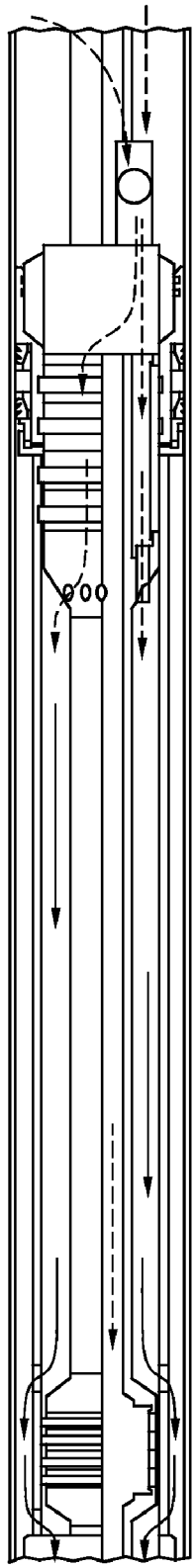
FIG. 9 is the FIG. 8 illustration with the interface valve shown in a position to allow fluid flow therethrough.

Referring now to FIGS. 8 and 9, another embodiment is illustrated. With respect to the foregoing embodiments, it has been stated that an inconsequential loss of fluid from the upper column is experienced once the stinger opens the valve 16. This is true for cases in which the upper completion string packer (not shown) is set quickly after the valve 16 is opened. In cases where there will be a delay for setting this packer, however, fluid from the upper column can escape from the upper column into the formation by flowing past the unset packer and through the valve 16 into the lower completion and out the screens 12. It is further noted that in such situations, the upper completion packer can be damaged by a high velocity flow of the upper column fluid rushing therepast while the fluid makes its way to the formation. In cases where the damage to the packer is severe, the configurations disclosed hereinabove would be for naught because once the packer is non functional, all of the upper column fluid will be lost to the formation with all of the attendant concerns identified early in this disclosure. For well systems where such a delay might occur, the alternate embodiment of FIGS. 8 and 9 will be particularly helpful. It is to be understood that the embodiment of FIGS. 8 and 9 are not limited to circumstances where a delay in the setting of the upper completion packer is anticipated but that the embodiment can indeed be used for all systems with slightly increased cost for the additional components needed.

Referring directly to FIG. 8, it will be recognized to be very similar to that of FIG. 7, which is replaced for illustration of this embodiment. Focusing upon the distinctions only from FIG. 7, attention is directed to the flow-through, no-go collar 70 from FIG. 7, which has been replaced with a non-flow-through, no-go collar 80 having an interface valve 82 in a housing 84. Collar 80, in this embodiment, is required to be sealed to the packer 22 since it is intended to prevent fluid flow therethrough until the valve 82 is opened. As illustrated, the valve 82 is also connected to a control line 86 for remote actuation but it is to be appreciated that while it is desirable to have remote actuation capability for this embodiment, such remote actuation can be achieved by a pressure up system with a release mechanism, for example, which will permanently open the valve 82 at the selected time, or can be any one of a number of other art recognized remote actuation systems (hydraulic, electric, optic, etc.) as desired. The valve can be configured as a one time opening valve, or can be configured as an openable and closeable valve. The valve 82 can even be configured as a variably positionable valve, if desired, without departing from the scope of the disclosure hereof. Because the collar 80 is a non-flow-through collar, it will hold the pressure of the upper fluid column when the valve 82 is closed. This prevents the high velocity flow of fluid from the upper fluid column migrating to the formation through the lower completion. Because the valve 82 is actuable at will, delay of any length is accomodatable by the embodiment of FIGS. 8 and 9. This provides the time necessary to deploy the upper completion packer discussed above, which subsequent to deployment will do the job of holding the upper completion fluid column. Referring to FIG. 9, the fluid flow path when the valve 82 is opened is illustrated. It will be apparent to those who have read and understood the foregoing that the flow is substantially identical to that of the earlier described embodiments once valve 82 is allowed to pas fluid.

While preferred embodiments have been shown and described, various modifications and substitutions may be made thereto without departing from the spirit and scope of the invention. Accordingly, it is to be understood that the present invention has been described by way of illustration and not limitation.

The invention claimed is:

1. A fluid loss control system having a loss control valve and a plurality of zones comprising:

an isolation assembly disposed in a wellbore; and a string having a stinger at a downholemost end thereof and supportive of a moveable seal at a selected position uphole of the stinger, the position being calculated to (1) cause engagement of the seal with the isolation assembly before the stinger is engageable with the valve and (2) to position the moveable seal relative to the isolation assembly to facilitate fluid-flow around the seal when the stinger is engaged with a valve of one of the plurality of zones.

2. The fluid control loss system as claimed in claim 1 wherein the isolation assembly includes a sealbore and a packer.

3. The fluid control loss system as claimed in claim 2 wherein the sealbore comprises a length at least as long as a zone of the plurality of zones extending downhole from the valve.

4. The fluid control loss system as claimed in claim 2 wherein the packer is supportive of the sealbore, the packer being selectively engageable with a borehole wall.

5. The fluid control loss system as claimed in claim 3 wherein the sealbore further includes a downhole end passable by the moveable seal as the stinger engages the seal bore of the one of the plurality of zones.

6. The fluid control loss system as claimed in claim 3 wherein a plurality of ports are positioned in the sealbore to accept the moveable seal therebetween facilitating fluid control around the seal.

7. The fluid control loss system as claimed in claim 2 wherein the packer and sealbore are spaced out from the lower completion by measurement when installing the packer.

8. The fluid control loss system as referenced in claim 2 wherein the packer and sealbore are spaced out from the pack automatically by landing a connector at the lower completion.

9. The fluid control loss system as referenced in claim 1 further comprising a selectively actuatable interface valve positioned to selectively allow and inhibit fluid communication through the fluid control loss system.

10. The fluid control loss system as referenced in claim 9 wherein the valve is positioned at an interface between the fluid loss control system and an upper fluid column.

11. The fluid control loss system as referenced in claim 9 wherein the valve is remotely actuatable.

12. A method for controlling fluid loss to a downhole formation where a fluid loss control valve is disposed at an uphole end of a lower completion, comprising:

isolating a fluid column uphole of a moveable pressure seal spaced from the lower completion;

opening the fluid loss control valve;

stabbing a stinger into a valve of the lower completion; and positioning the moveable seal to facilitate fluid flow therearound from the fluid column uphole of the moveable seal, while the stinger is engaged with the valve.

13. The method for controlling fluid loss to a downhole formation as claimed in claim 12, the method further comprising maintaining separate zones in the lower completion by flowing fluid through an inside dimension of the stinger for a more downhole zone and flowing fluid around the moveable seal for a more uphole zone.

14. The method for controlling fluid loss to a downhole formation as claimed in claim 12, the method further comprising maintaining separate zones in the lower completion by flowing fluid through an inside dimension of the stinger for a more uphole zone and flowing fluid around the moveable seal for a more downhole zone.

15. The method for controlling fluid loss to a downhole formation as claimed in claim 12, wherein the isolating includes installing an isolation assembly having a length and position relative to the lower completion to communicate with a moveable seal such that isolation is achievable.

16. The method for controlling fluid loss to a downhole formation as claimed in claim 12, wherein the positioning of the movable seal is disposing the seal downhole of a downhole end of the sealbore to thereby defeat sealing between the seal and the sealbore.

17. The method for controlling fluid loss to a downhole formation as claimed in claim 12, wherein the positioning of the movable seal is disposing the seal between a plurality of ports in the sealbore.

18. The method for controlling fluid loss to a downhole formation as claimed in claim 12, wherein the isolating includes installing a packer and sealbore uphole of the lower completion by measuring placement of the packer while installing.

19. The method for controlling fluid loss to a downhole formation as claimed in claim 12, wherein the isolating includes installing a packer and sealbore uphole of the lower completion by stabbing a connector into the lower completion thereby automatically spacing the sealbore.

20. The method for controlling fluid loss to a downhole formation as claimed in claim 12, wherein the isolating further includes actuating an interface valve to allow fluid communication between an upper fluid column and the fluid loss control valve.

* * * * *